United States Patent [19]

de Putter et al.

[11] 4,322,486

[45] Mar. 30, 1982

[54] ELECTROPHOTOGRAPHIC PROCESS INVOLVING DOUBLE CHARGING

[75] Inventors: Jan A. de Putter, Velden; Johannes Kortenoeven, Helden-Panningen, both of Netherlands

[73] Assignee: Oce-van der Grinten N.V., Venlo, Netherlands

[21] Appl. No.: 22,732

[22] Filed: Mar. 22, 1979

[30] Foreign Application Priority Data

Mar. 29, 1978 [NL] Netherlands ..... 7803301

[51] Int. Cl.[3] ..... G03G 13/02; G03G 13/22

[52] U.S. Cl. ..... 430/31; 430/67; 430/952; 361/225

[58] Field of Search ..... 430/31, 67, 87, 902; 361/225

[56] References Cited

U.S. PATENT DOCUMENTS

| | | | |
|---|---|---|---|
| 3,041,167 | 6/1962 | Blakney et al. | 430/902 X |
| 3,429,701 | 2/1969 | Koehler | 430/902 X |
| 3,677,751 | 7/1972 | Ohta et al. | 430/902 X |
| 4,063,945 | 12/1977 | Von Hoene et al. | 430/902 X |

*Primary Examiner*—Roland E. Martin, Jr.

*Attorney, Agent, or Firm*—Albert C. Johnston

[57] ABSTRACT

In a process for the formation of an electrostatic image on a photoconductive element comprising a photoconductive zinc oxide-binder layer and an insulating top layer, the top layer is first positively charged and then is negatively charged until the element is saturated with negative charge, after which the top layer is imagewise exposed to light.

5 Claims, 3 Drawing Figures

ELECTROPHOTOGRAPHIC PROCESS INVOLVING DOUBLE CHARGING

This invention relates to a process for the formation of an electrostatic image, in which process a photoconductive element comprising an electrically conductive layer, a photoconductive layer of zinc oxide dispersed in a binder and an electrically insulating top layer is first positively and then negatively charged and is subsequently exposed imagewise to light.

Photoconductive elements made with a photoconductive layer of zinc oxide dispersed in an organic binder are used in both direct and indirect electrophotographic processes. For indirect electrophotography it is important that the photoconductive elements provided be satisfactory during a long period of service, because frequent replacement of the photoconductive element is costly and is undesirable in other respects.

Various proposals have been made for lengthening the service life of a photoconductive element by providing the photoconductive layer with an insulating top layer, for which purpose a very thin top layer generally is chosen. This, however, is detrimental in that discharge of the photoconductive element by light is less complete when employing the conventional method of image formation, in which the photoconductive element is charged only once for each imagewise exposure. This detriment can be avoided if the charge image is formed by the process described in U.S. Pat. No. 3,677,751, in which a photoconductive element comprising a conductive support, a photoconductive layer and an electrically insulating top layer is first charged with one polarity and subsequently with the opposite polarity so that the quantity of charge applied by the second charging is smaller than that of the first charging. In that way, when the photoconductive layer is based on a dispersion of zinc oxide in a binder, the photoconductive element is first positively and then negatively charged, and after imagewise exposure an electrostatic image is obtained having a negative potential in the image areas and a positive potential in the background. That known process, however, has the disadvantage that the image formation is highly dependent on the quantity of charge applied by the second charging. In its use, therefore, the quantity of charge applied by the second charging should be dosed exactly, but even then, due to unequal charge-dosing by the negative charging corona in the second charging step, it is not practicable to prevent the charge from being distributed irregularly in the image.

The influence of the second charging step on the image formation is illustrated, for the case of a photoconductive element based on zinc cadmium sulphide and having an insulating top layer, in FIG. 4 of Denshi Shashin (Electrophotography) Vol. 9 (1970) No. 2, pages 46–56. That figure shows different light-discharge curves with the resulting residual potentials for such a photoconductive element which was charged up to various potentials in the second charging step.

Figure 1:
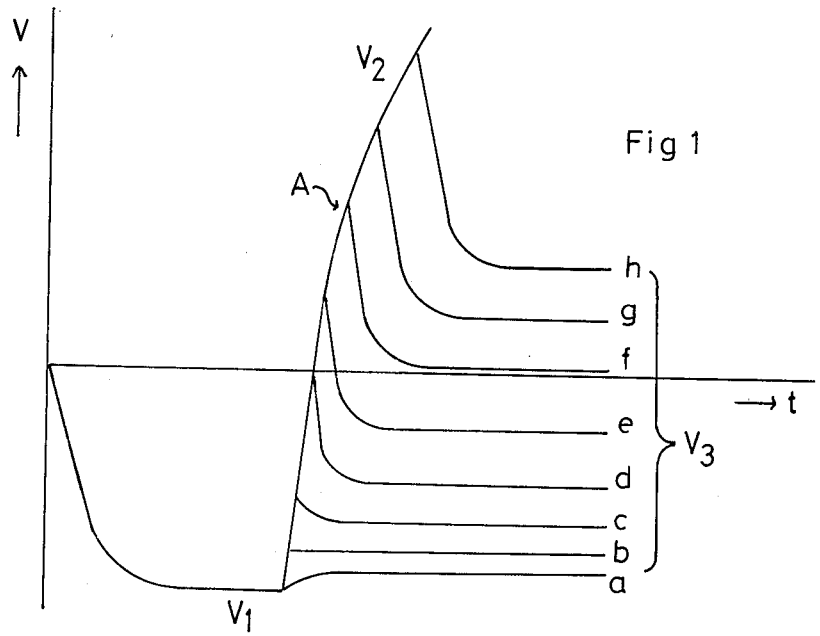

Those light-discharge curves are represented at a up to and including h in FIG. 1 of the accompanying drawings, which represents the surface potential as a function of time. From FIG. 1 it can be deduced that at unchanging negative charging in the first charging step ($V_1$) and increasing height of positive charging in the second charging step ($V_2$), the residual potential ($V_3$) left after exposure rises from negative via zero to positive and when positive has the same polarity as the charge image. Thus, it can be concluded that the charging, in order to prevent a charge image from being formed on a background having the same polarity in the second charging step, should not be extended farther than up to a certain level represented at A in FIG. 1. From FIG. 1 it can also be deduced that the difference between $V_2$ (the potential of the non-exposed parts) and $V_3$ (the potential in the exposed parts) varies when light-discharge is performed at various values of $V_2$. Therefore, contrast differences are also produced by irregularities in the second charging step.

The principal object of the present invention is to provide a process which avoids the above-mentioned disadvantages of known processes, so a process for producing with the use of a photoconductive element of the type first above mentioned charge images which can be developed into contrasty images having substantially constant extent of contrast, without development of the background and without irregularities as a result of irregular charge distribution by the negative corona.

In accordance with the invention, it has been found that said disadvantages can be avoided in a process for the formation of an electrostatic image by first positively and then negatively charging, and subsequently imagewise exposing, a photoconductive element that comprises an electrically conductive layer, a photoconductive zinc oxide-binder layer and an electrically insulating top layer, by continuing the negative charging of the top layer at least until the photoconductive element is saturated with charge.

Surprisingly it has been found that, contrary to what is indicated by FIG. 4 of the Denshi Shashin literature reference, no negative image is obtained on a negative background when a photoconductive element of the type mentioned, having a photoconductive layer based on a dispersion of zinc oxide in a binder, is charged in the second charging step until it is saturated with negative charge. The image obtained is a negative image on a positive background, and it exhibits a substantially constant potential notwithstanding irregular charging by the negative charging corona.

The process according to the invention is advantageous in the use of photoconductive layer made of a dispersion of zinc oxide in a binder. The zinc oxide employed in the photoconductive layer can be any of the normal zinc oxides produced for electrophotographic use, or can also be a continuous tone zinc oxide such, for example, as those marketed under code numbers CT011, CT012 and CT2378. The zinc oxide may also be panchromatically sensitive zinc oxide, such as the zinc oxide known as pink zinc oxide. This can be obtained by treating zinc oxide with carbon dioxide and ammonia gas followed by heating at a temperature of about 250° C., as described in British Pat. No. 1,489,793. The zinc oxide or pink zinc oxide may be sensitized in the usual way with one or more of the dyes known for sensitizing zinc oxide, such as bromophenol blue, rhodamine B, eosine, fluorescein, and such.

The binder of the photoconductive layer may consist of any polymer which is usual for photoconductive zinc oxide-binder layers. Suitable binders are, for instance, styrene-acrylate copolymers, such as products E041, E048 and E312 of De Soto Chemical Company and Synolac 620 S of the firm Cray-Valley, epoxy resins such as a Shell product known as Epikote 872, which can be hardened with a hardener such as diethyltriamine, and various vinyl resins, such for example as the vinyl chloride acrylic ester copolymer having free hydroxyl groups which is marketed under the name Rhodopas ACVX by the firm Rhône-Poulenc. The ratio of zinc oxide to binder in the photoconductive layer is not critical and can be selected at any usual value between 10:1 and 3:1. The thickness of the photoconductive layer is also not critical; any thickness usual for zinc oxide-binder layers, lying between about 10 and 50 μm, can be employed.

The insulating top layer of the photoconductive element may be formed of any suitable electrically insulating polymer. Polymers having a specific resistance above $10^{13}$ ohm.cm, such as polyvinylcarbazole, polyvinylpyrene, polystyrene, phenoxy resins and acrylic resins are very suitable. The thickness of the top layer is not critical. A thickness even up to 15 μm is usable, but in general it is sufficient to have layer thicknesses of about 3 to 5 μm. Thinner layers down to about 1 μm are also usable, but it is difficult to form or handle them because of their slight thickness.

The electrically conductive support of the photoconductive element may be composed of metal such as aluminium, paper or a plastic, to which when so desired one or more conductive layers or insulating layers may have been applied. For instance, a polyethyleneterephthalate film provided with a conductive metal layer, or with a conductive layer formed of a dispersion of carbon in a binder, is very suitable.

The charging of the photoconductive element can be effected in any usual way, for instance with the use of corona wires connected to a potential of between 5 and 10 kV. The first (positive) charging step, as well as the second (negative) charging step, can be continued until the photoconductive element is saturated with charge. On the other hand, since the first charging step gives rise much less to inequalities in the charge image, this step can be used to charge the element to a lower potential and in this way, to a certain extent, to adjust the contrast in the charge image. For instance, the first charging step can be interrupted at the moment when the potential has increased to 40% of the maximum potential. If so desired, a homogeneous exposure of the photoconductive element to light can be effected during or after the first charging in order to accelerate adjustment of the charge equilibrium, but in general this is superfluous.

The charging in the second charging step generally should be continued until at least twice the time necessary for approaching the saturation potential. This is advisable because, due to various inhomogeneities which are likely to be present in the photoconductive element itself and/or in the charging corona, the photoconductive element may not be saturated with charge simultaneously over its whole surface. The invention and preferred ways of practicing it will be understood further from the illustrative examples set forth below:

EXAMPLE 1

A photoconductive element was made with its layers in reversed order, by first forming the top layer on a smooth auxiliary support, then applying over the top layer, successively, a photoconductive layer and the support of the element, and subsequently removing the auxiliary support.

The auxiliary support used in this example was a smooth polyethyleneterephthalate film coated with a solution of 10 percent by weight of a phenoxy resin (Rutapox 0717 of Rutgerswerke A.G.) in methylglycol acetate. The thickness of the dried coating layer was 3 μm. On this layer a zinc oxide dispersion of the following composition was applied:

- 100 g of pink zinc oxide obtained by treating electrophotographic zinc oxide with a mixture of $CO_2$ and $NH_3$ gas up to a weight increase of 6%, followed by heating to a constant weight,
- 20 g of a styrene-acrylate copolymer (E312 of De Soto Chemical Co.) dissolved in an equal weight-quantity of toluene,
- 400 mg of bromochlorophenol blue, and 115 g of toluene.

The thickness of the dried zinc oxide-binder layer was 15 μm.

A support consisting of a polyethyleneterephthalate foil coated on both sides with a conductive dispersion of carbon in cellulose acetate butyrate was adhered to the zinc oxide-binder layer with the aid of a polyvinyl acetate glue (Mowilith 30 of Hoechst A.G.). Finally the smooth auxiliary support was removed.

The photoconductive element thus obtained was subjected to charging with a positive corona of 8.5 kv followed by charging with a negative corona of 7.5 kV and then by imagewise exposure to light, in repeated tests as represented in Table I. In all cases the exposure was effected with a Xenon flash lamp and required about 7 μJ/cm² of light.

TABLE I

| Test | First charging time(sec) | Potential after first charging($V_1$) | Second charging time | Potential after second charging($V_2$) | Potential after exposure |
|---|---|---|---|---|---|
| 1 | 2 | +350 V | 0.1 | +150 V | +260 V |
| 2 | 2 | +350 V | 0.25 | −50 V | +225 V |
| 3 | 2 | +350 V | 0.5 | −300 V | +190 V |
| 4 | 2 | +350 V | 1.0 | −440 V | +160 V |
| 5 | 2 | +350 V | 2.0 | −450 V | +150 V |
| 6 | 2 | +350 V | 3.5 | −450 V | +150 V |

Figure 2:
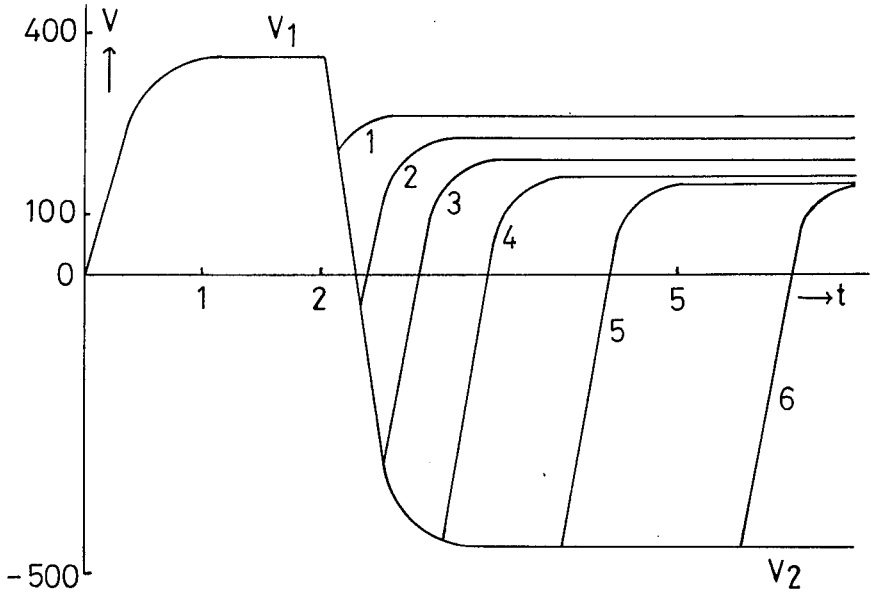

The course of the chargings and light-discharges, in Volts as functions of the time in seconds, is represented in the graph presented as FIG. 2 of the drawings. From that graph and Table I it is seen that when charging to saturation in the second charging step not only the potential after second charging but also the potential after exposure becomes independent of the charging time (of the quantity of charging, respectively) and a constant image contrast of 600 V results.

Figure 3:
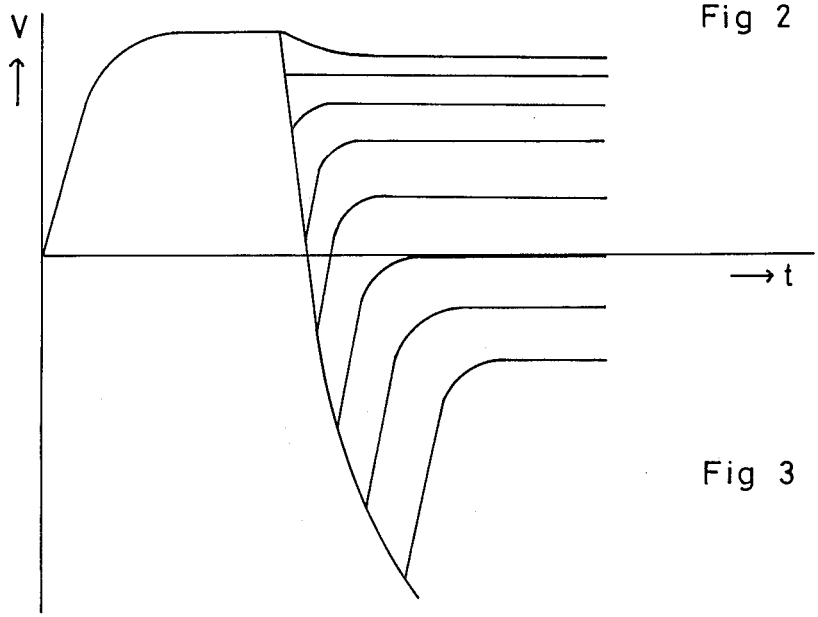

In tests 5 and 6 the whole photoconductive element was saturated with charge after the second charging, and inhomogenity of the negative corona no longer had any influence on the image. For comparison, a reflected image of FIG. 1 is represented in FIG. 3. As already explained, FIG. 1 relates to photoconductive elements based on zinc cadmium sulphide. The potentials in FIG. 1 represent only relative values, because in the Denshi Shashin literature reference absolute numerical values are not mentioned.

The tests 1 through 6 were repeated with a variation in that the first charging time was halved. The results obtained were the same as those indicated in Table I.

EXAMPLE II

Example I was repeated in the same way with the exception that the thickness of the photoconductive layer was doubled to 30 μm. In this case the potential observed at positive charging amounted to +350 V, just as in example I. The saturation potential after second charging was −900 V, while the potential after exposure amounted to +150 V, just as in Example I. The image contrast consequently was 1050 V.

EXAMPLE III

Example I was repeated in the same way with the exception that the thickness of the insulating top layer was increased to 5 μm. In this case the potential at positive charging increased to about 550 V, while the maximum potential after the second (negative) charging and the potential after exposure had both moved in positive direction by about 100 V relative to the values of Example I. The image contrast remained equal to that obtained according to Example I.

We claim:

1. In a process for the formation of an electrostatic image by first positively and then negatively charging, and then imagewise exposing to light, the top layer of a photoconductive element that comprises an electrically conductive layer having thereon a photoconductive zinc oxide-binder layer covered by an electrically insulating top layer of not more than about 15 microns in thickness, the improvement which comprises effecting the negative charging by continuing it at least until the photoconductive element is saturated with negative charge, thereby upon said exposing producing on said element a developable negatively charged electrostatic image in a positively charged background with a substantially constant potential contrast between the image and the background areas.

2. A process according to claim 1, in which the negative charging is continued for at least twice the time required for bringing any area of the top layer ot approximately its saturation potential.

3. A process according to claim 1 or 2, in which the first charging is continued until the photoconductive element is saturated with positive charge.

4. A process according to claim 1 or 2, in which the first charging is discontinued when the photoconductive element reaches a selected positive potential substantially lower than its saturation potential, thereby providing a selected contrast of potentials in the charge image formed by the imagewise exposing of the element.

5. A process according to claim 1 or 2, said top layer having a thickness in the range of about 1 to about 15 microns.

* * * * *